US005157911A

United States Patent [19]

Stahlecker et al.

[11] Patent Number: 5,157,911

[45] Date of Patent: Oct. 27, 1992

[54] ARRANGEMENT FOR FALSE-TWIST SPINNING

[76] Inventors: Fritz Stahlecker, Josef-Neidhart-Strasse 18, 7347 Bad Überkingen; Hans Stahlecker, Haldenstrasse 20, 7334 Süssen, both of Fed. Rep. of Germany

[21] Appl. No.: 620,046

[22] Filed: Nov. 30, 1990

[30] Foreign Application Priority Data

Dec. 1, 1989 [DE] Fed. Rep. of Germany ..... 3939777

[51] Int. Cl.[5] ..... D02G 3/00; D01H 1/02

[52] U.S. Cl. ..... 57/328; 57/315; 57/333

[58] Field of Search ..... 57/328, 333, 401, 90, 57/315, 408, 411

[56] References Cited

U.S. PATENT DOCUMENTS

| | | | |
|---|---|---|---|
| 3,487,619 | 1/1970 | Field | 57/328 |
| 4,290,170 | 9/1981 | Brookstein et al. | 57/90 X |
| 4,488,397 | 12/1984 | Venot | 57/328 |
| 4,524,580 | 6/1985 | Fehrer | 57/328 |
| 4,565,063 | 1/1986 | Stadler et al. | 57/328 |
| 4,584,830 | 4/1986 | Faure et al. | 57/328 |
| 4,724,668 | 2/1988 | Wassenhoven | 57/333 |
| 4,930,303 | 6/1990 | Mori et al. | 57/328 |

FOREIGN PATENT DOCUMENTS

| | | | |
|---|---|---|---|
| 3714212 | 11/1988 | Fed. Rep. of Germany . | |
| 2215743 | 9/1989 | United Kingdom | 57/90 |

*Primary Examiner*—Daniel P. Stodola
*Assistant Examiner*—William Stryjewski
*Attorney, Agent, or Firm*—Evenson, Wands, Edwards, Lenahan & McKeown

[57] ABSTRACT

In an arrangement for pneumatic false-twist spinning having a drafting unit, a pneumatic false-twisting device which follows and a withdrawal device which follows, it is provided that a roller of the pair of delivery rollers is constructed as a hollow roller which has an air-permeable shell surface. In addition, a suction roller is provided between the pair of delivery rollers and the false-twisting device.

26 Claims, 4 Drawing Sheets

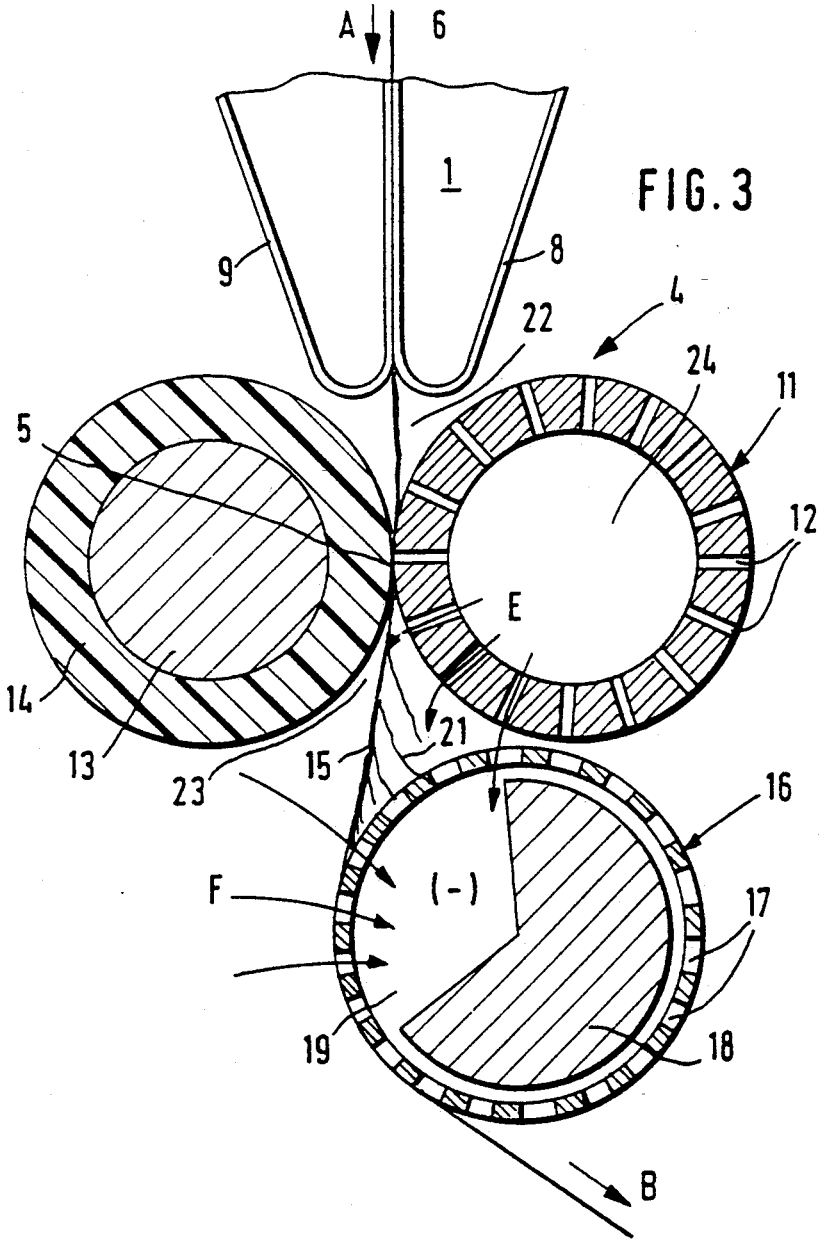
FIG. 3
FIG. 4
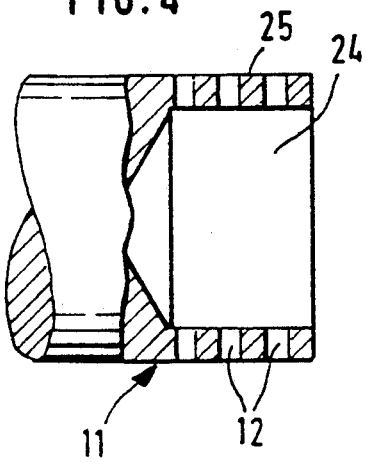
FIG. 5
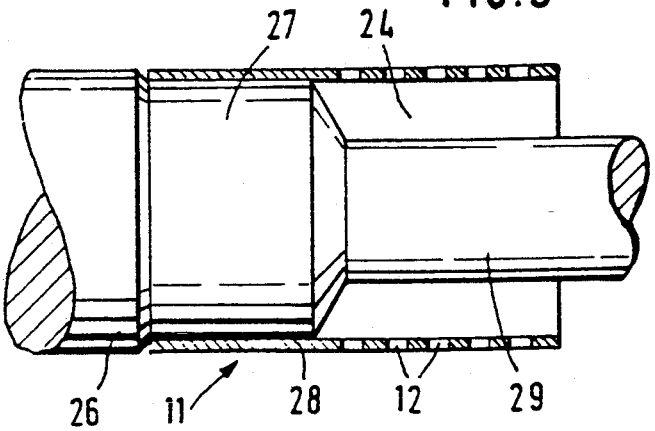

13
14
5
9
2
10
6
21
15
19
18
34
3
A
(-)
(-)
1
32
33
20
8
11
16
B
4
31
7
35

37
25
32
31

11
12
36

39
11
31
32
40
42

38
19
43
41
18
16

ARRANGEMENT FOR FALSE-TWIST SPINNING

BACKGROUND AND SUMMARY OF THE INVENTION

The invention relates to an arrangement for false-twist spinning having a drafting unit, a following pneumatic false-twisting device and a following withdrawal device, a drivable rotation body subjected to suction which forms a guiding surface for a sliver being arranged between a pair of delivery rollers of the drafting unit and the false-twisting device.

In a known arrangement of the initially mentioned type German Patent Document DEA 37 14 212, one or two drivable rotation bodies subjected to suction are arranged between the pair of delivery rollers of the drafting unit and a false-twisting nozzle by means of which the sliver is laterally deflected in its travelling direction. By means of reversing the direction of the yarn travel, edge fibers are to be spread away from the core of the sliver which subsequently, after passing though the false-twisting nozzle, remain wound around the sliver resulting in a spun yarn.

In the case of arrangements of this type for pneumatic false-twist spinning, the drafting units operate at very high delivery speeds; i.e., the rollers of the pair of delivery rollers rotate very rapidly. These rollers generate a co-rotating air flow which is disturbed in the area of the nip line between the two rollers and must flow off in the longitudinal direction of the nip line. This disturbance of the air flow leads to the risk that the fiber position of the sliver entering into the nip line is disturbed considerably so that the fibers are moved out of their position in which they are parallel to one another per se. There is the danger that in the process fiber ends are bent backwards and result in hairpin-type fiber orientations.

It is an object of the invention to develop an arrangement of the initially mentioned type such that a controlled fiber position is obtained and thus a uniform yarn can be produced.

This object is achieved in that at least one roller of the pair of delivery rollers is constructed as a hollow roller which has an air-permeable shell surface.

As a result of this development, the generating and the flowing-off of air currents can be controlled that rotate along with the rollers so that therefore an improved and orderly fiber position is obtained. In practice, as a rule, only one of the rollers is constructed as an air-permeable hollow roller because the other roller is provided with an elastic covering on its circumference.

As a further development of the invention, it is provided that a suction device is arranged on the inside of the hollow roller which generates an air current directed from the outside toward the inside. The forming air current can be controlled by means of a suction device.

In a further development of the invention, it is provided that the suction device has a suction slot which is directed to the travelling path of the sliver, particularly to the area in front of a nip line of the pair of delivery rollers. By means of this development, not only the corresponding air current can be controlled, but it is also possible to, in a controlled manner, spread fiber ends away from the sliver which are utilized for the later winding-around. In this case, it is expedient for the air-permeable area of the hollow roller to be arranged laterally next to the travelling path of the yarn. As a result, the fiber ends which are required for the winding-around can then be spread away with a controlled component in the longitudinal direction of the nip line.

In a further, particularly advantageous development of the invention, it is provided that the rotation body is driven to a circumferential speed which is higher than the delivery speed of the pair of delivery rollers of the drafting unit and higher than the withdrawal speed of the withdrawal device. As a result, it is possible to wind the fiber ends spread away in the area of the rotation body, in a controlled manner, around the sliver rotating on the guiding surface of the rotation body as a result of the received false twist so that, after the opening-up of the false twist, a controlled winding-around of fiber ends is obtained. The guiding surface of the rotation body moves ahead of the sliver and in the process takes along the spread-away fiber ends so that they are wound around the sliver with a slope directed against the false twist.

In a further development of the invention, it is provided that a suction device is arranged in the rotation body which has a suction slot extending in the travelling direction of the yarn, the start of the suction slot being directed to the area of the nip line of the pair of delivery rollers of the drafting unit. As a result, a controlled air current is achieved in the area directly behind the nip line which promotes the spreading-away of fiber ends. The spreading-away will be particularly effective and the winding-up will be controlled better if, in a further development of the invention, an air-permeable area of the rotation body and/or the suction slot are arranged laterally next to the travelling path of the yarn.

In a further development of the invention, it is provided that the hollow roller and the rotation body have a diameter of maximally 30 mm, the hollow roller preferably having a smaller diameter than the rotation body. As a result, it is possible to arrange the axes of the roller and of the rotation body very close to one another so that a spinning of short staple lengths is also possible in a controlled manner. If the hollow roller and the rotation body have the same diameter, manufacturing expenditures may be reduced. In this case, it is advantageous for the distance between the nip line of the pair of delivery rollers and of the guiding surface of the rotation body to be smaller or equal to the medium fiber length of the fiber material to be processed.

In a further development of the invention, it is provided that the rotation body is arranged to be offset with respect to a drafting plane extending in parallel to the axes of the rollers of the drafting unit. As a result, it is achieved that the core of the sliver takes another route than the fiber ends to be spread away so that the spreading-away is particularly effective.

In a further development of the invention, it is provided that the false-twisting device consists of a false-twisting nozzle which has a yarn duct aligned at least approximately tangentially with respect to the guiding surface of the rotation body. In this case, it is advantageous for the false-twisting nozzle to be held by means of a holding device which can be adjusted concentrically with respect to the axis of the rotation body. As a result, it is possible to adjust the windaround angle of the sliver by means of which this sliver runs on the rotation body.

In a further development of the invention, it is provided that a cleaning device is provided for the hollow roller and/or the rotation body. As a result, it is ensured that uniform spinning conditions are maintained even over a longer operating duration because then the air-permeable areas of the hollow roller and of the rotation body cannot be clogged by flying fiber or the like.

Other objects, advantages and novel features of the present invention will become apparent from the following detailed description of the invention when considered in conjunction with the accompanying drawings.

BRIEF DESCRIPTION OF THE DRAWINGS

FIG. 3 is an enlarged sectional view of the embodiment according to FIG. 1;

FIG. 4 is a partial sectional view of the roller of the pair of delivery rollers of the drafting unit which is constructed as a hollow roller;

FIG. 5 is a partial sectional view of another embodiment of the roller of the pair of delivery rollers of a drafting unit which is constructed as a hollow roller;

DETAILED DESCRIPTION OF THE DRAWINGS

Figure 1:
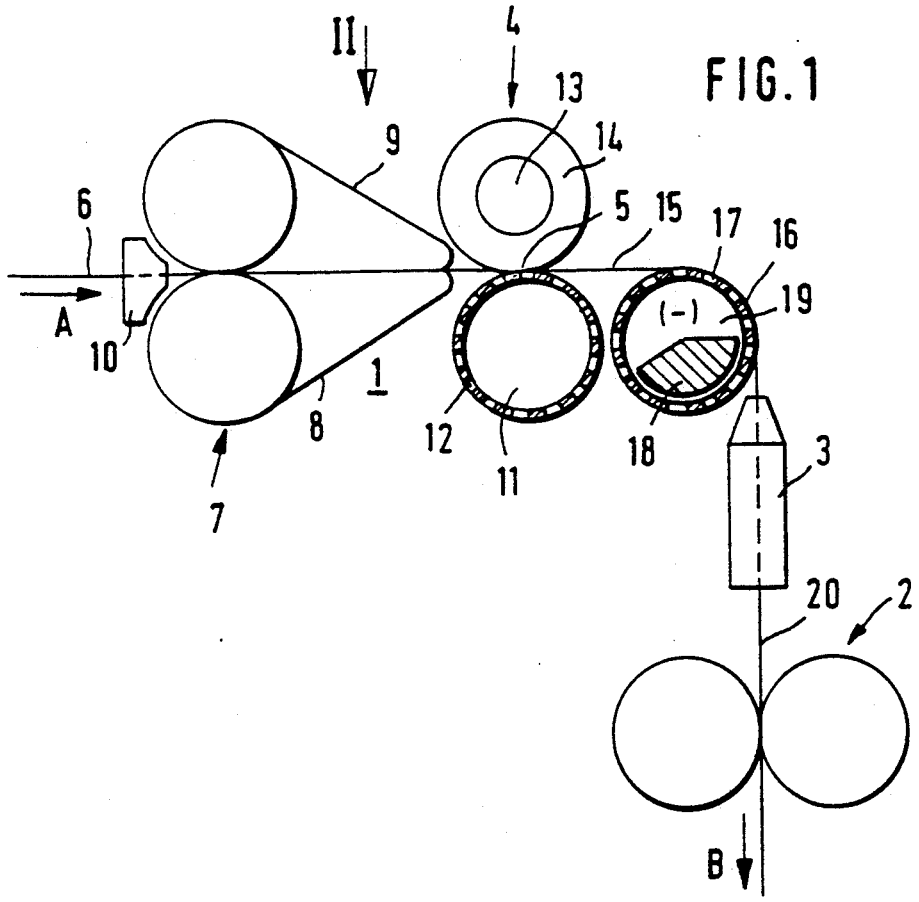
FIG. 1 is a schematic partially sectional lateral view of an arrangement constructed according to the invention.

FIG. 1 illustrates a single arrangement for pneumatic false-twist spinning. In the case of a machine used in practice, a plurality of arrangements of this type are arranged in a row next to one another on one side of the machine.

The arrangement according to FIG. 1 comprises a drafting unit 1 which is shown only partially and which is followed by a pneumatic false-twisting nozzle 3 which is followed by a withdrawal device 2 from which the spun yarn 20 travels in the direction of the arrow (B) to a wind-up device which is not shown and on which the yarn 20 is wound to a cross-wound package.

A sliver 6 travels through the drafting unit 1 in the direction of the arrow (A), is drawn to the desired yarn size in the drafting unit, and is supplied as a drawn sliver 15 by the pair of delivery rollers 4. In front of the pair of delivery rollers 4, a pair of rollers 7 is arranged which is equipped with an apron unit comprising a bottom apron 8 and a top apron 9. In front of this pair of rollers 7, a condenser 10 is arranged which condenses the sliver 6 before it travels into the pair of rollers 7 and into the apron unit.

Figure 2:
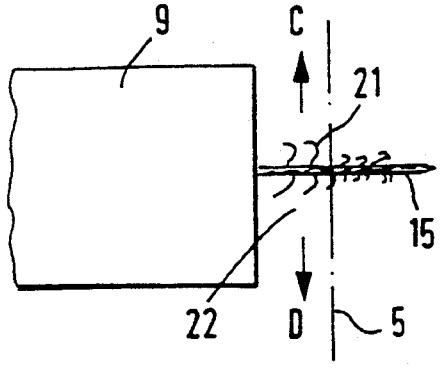
FIG. 2 is a representation of an area of a drafting unit in front of a nip line of a pair of delivery rollers for explaining the air currents arising there in the case of the state of the art.

The pair of delivery rollers 4 forms a nip line 5 for the sliver. In the case of conventional drafting units, the pair of delivery rollers 4 has rollers with closed shell surfaces. As a result, an air current develops in the area of the nip line 5, as illustrated in FIG. 2. The rollers of the pair of delivery rollers rotating at high rotational speeds generate a co-rotating air current. Since the nip line 5 is virtually impermeable to air, this air current must flow off in the inlet area 22 in front of the nip line essentially in the longitudinal direction of the nip line 5, as indicated by the arrows (C and D). The risk therefore exists that fiber ends are delayed by this air current and are deflected against the travelling direction of the drawn sliver, in a hairpin-type manner toward the rear. This interference with the fiber position in the later yarn results in an impairment of the strength and mainly also of the appearance.

In the arrangement according to the invention, the pair of delivery rollers 4 comprises a hollow roller 11, the shell of which is provided with a perforation, and a pressure roller 13 which is provided with a rubber-elastic covering 14 on its circumference. As a result of the perforation 12, the generating of an air current corresponding to the arrows (C and D) of FIG. 2 is prevented.

A rotation body 16 is arranged between the pair of delivery rollers 4 and the pneumatic false-twisting nozzle 3, the drawn sliver 15 being guided around this rotation body at an angle of approximately 90°. The pneumatic false-twisting nozzle 3 has a yarn duct which is arranged tangentially with respect to the rotation body 16. Blow openings lead tangentially into this yarn duct so that an air swirl is formed which generates a false twist in the drawn sliver 15. The rotation body 16 is provided with a perforation 17 in the area of its guiding surface. In its interior, a suction insert 18 is arranged which, by means of a suction slot 19 extending in the circumferential direction, is directed against the interior surface of the rotation body 16. The suction insert 18 and the suction slot 19 are connected to a vacuum source in a manner not shown in detail. The length of the suction slot 19 is defined such in the circumferential direction that its beginning is directed to the area of the nip line of the pair of delivery rollers. It ends at the point at which the sliver 15 detaches from the rotation body 16. The rotation body 16 is drivable, specifically at such a speed that the circumferential speed of its guiding surface is higher than the delivery speed of the pair of delivery rollers 4 and the withdrawal speed of the withdrawal device 2. The delivery speed of the pair of delivery rollers 4 of the drafting unit 1 is equal to the withdrawal speed of the withdrawal device 2 or slightly lower, for achieving a negative draft. The circumferential speed of the guiding surface of the rotation body 16 may be up to 50% higher.

The false-twisting nozzle 3 provides a false twist to the sliver 15 as a result of which the sliver 15, while rotating around its axis, rolls off on the rotation body 16. In the area of the nip line 5, edge fibers are spread away from the sliver 15 as a result of the suction effect of the suction device 18, which fiber are subsequently wound around the sliver on the rotation body. In this case, the spread-away fiber ends move approximately at the circumferential speed of the guiding surface of the rotation body 16, while the core of the sliver 15 travels more slowly and slides on the rotation body 16. The fiber ends are therefore wound around the fiber core with a different twist and mainly with a different slope so that these fiber ends after the opening-up of the false twist in the fiber core remain wound around this fiber core and thus determine the strength and the appearance of the spun yarn 20.

The embodiment shown enlarged according to FIG. 3 corresponds essentially to the embodiment according to FIG. 1. As a deviation from the embodiment according to FIG. 1, however, the rotation body 16 is arranged offset with respect to the drafting plane of the drafting unit in the direction of the pressure roller 13, this drafting plane being defined by the areas of the bottom apron 8 and of the top apron 9 which adjoin one another. Thus, the core of the sliver 15, after leaving the nip line 5, is deflected slightly in the direction of the pressure roller 13. From the sliver 15 which was drawn to the desired yarn size, fiber ends 21 are spread away in the wedge-shaped gap 23 behind the nip line 5. As shown in FIG. 3, the suction slot 19 of the suction device 18 of the rotation body 16 sucks up air from the wedge-shaped gap area 23. In this case, air flows in after it in the direction of the arrows (E) from the interior of the hollow roller 11 of the pair of delivery rollers 4 of the drafting unit 1. If a sufficiently strong vacuum source is connected to the suction device 18, air may also be taken in in the direction of the suction slot 19 of the rotation body 16 from the inlet area 22 through the hollow roller 11.

In an embodiment that is modified with respect to FIG. 1 and 3, it is provided that the perforation 12 of the hollow roller 11 and/or the perforation 17 of the rotation body 16 are arranged laterally next to the yarn travelling path for the sliver 15. As a result, it is achieved that the spreading-away of the fiber ends 2 from the sliver 15 takes place with a component in the longitudinal direction of the nip line 5.

A first embodiment of a hollow roller 11 is illustrated in FIG. 4. This hollow roller 11 comprises an individually drivable shaft end 25 which, from the direction of one side, is provided with a longitudinal bore 24 in the area of which the perforation 12 is provided.

FIG. 5 illustrates an embodiment in which the hollow roller 11 is a part of a cylinder which extends through in the longitudinal direction of the machine, is drivable at the machine end and extends along a plurality of spinning arrangements of this type. In this embodiment, the bottom cylinder 26 is provided with two step-shaped shoulders 27, 29. A sleeve 28 is pressed onto the shoulder 27 with the larger diameter, this sleeve 28, in the area of the shoulder 29 with the smaller diameter, being provided with perforations 12 so that an annular chamber 24 is formed which permits a flowing-through of air.

Figure 6:
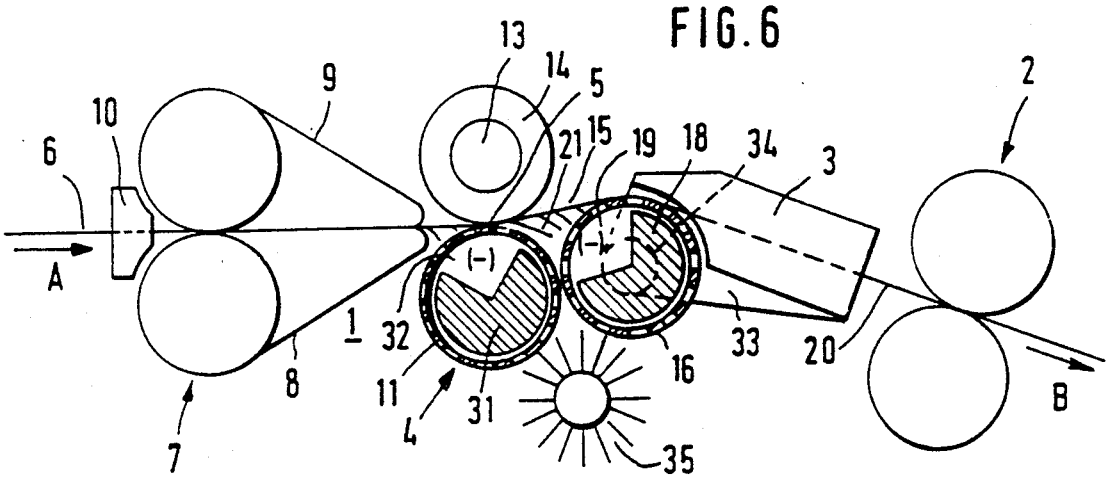
FIG. 6 is a partially sectional view of an embodiment similar to FIG. 1 having a cleaning device for the hollow roller and the rotation body.

The embodiment according to FIG. 6 corresponds essentially to the embodiment according to FIG. 1 or 3, however, with the important difference that the hollow roller 11 of the pair of delivery rollers 4 is provided with a suction insert 31 which has a suction slot 32 which is connected to a vacuum source, extends in the circumferential direction, and is directed essentially to the inlet area in front of the nip line 5. As a result, it becomes possible to spread away, already in this area, edge fibers from the sliver 6 which is still in the condition of being drawn. These spread-away edge fibers are then spread away in an increased manner by the rotation body 16 situated on the same side with respect to the now drawn sliver as the hollow roller 11; i.e., by means of the suction effect of the suction slot 19 of the suction insert 10.

In the embodiment according to FIG. 6, it is also provided that the false-twisting nozzle 3 is held by means of a holder 33 so that it can be adjusted around an axis 34 which is concentric with respect to the axis of the rotation body 16. By adjusting the position of the false-twisting nozzle 3, the wind-around angle can be changed by which the sliver 15 winds around the rotation body 16. This may influence to which extent the false twist provided to the sliver 15 by the false-twisting nozzle 3 extends back into the area of the nip line 5 of the pair of delivery rollers 4.

In the embodiment according to FIG. 6, a cleaning device is also provided in the form of a cleaning roller 35 equipped with bristles which is arranged in the area facing away from the sliver 15 between the hollow roller 11 and the rotation body 16. This cleaning roller 35 is drivable at a low rotational speed against the rotating direction of the hollow roller 11 and of the rotation body 16. This cleaning roller 35 provides that the perforations 12, 17 of the hollow roller 11 and of the rotation body 16 remain open also after an extended operation and are not clogged by flying fibers or the like.

Figure 7:
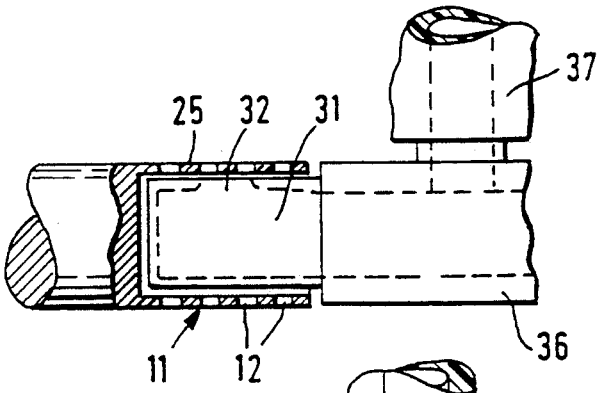
FIG. 7 is a sectional view of a roller of a pair of delivery rollers of the drafting unit which is constructed as a hollow roller, having a suction device.

As illustrated in FIG. 7, the hollow roller 11 of FIG. 6 is constructed as a shaft end 25, a stationary suction insert 31 being fitted into the axial bore of this shaft end 25 and comprising a suction slot 32. A flexible hose line 37 is connected to the part 36 of the suction insert which is situated outside the shaft end 25 and leads to a vacuum source which is not shown.

Figure 8:
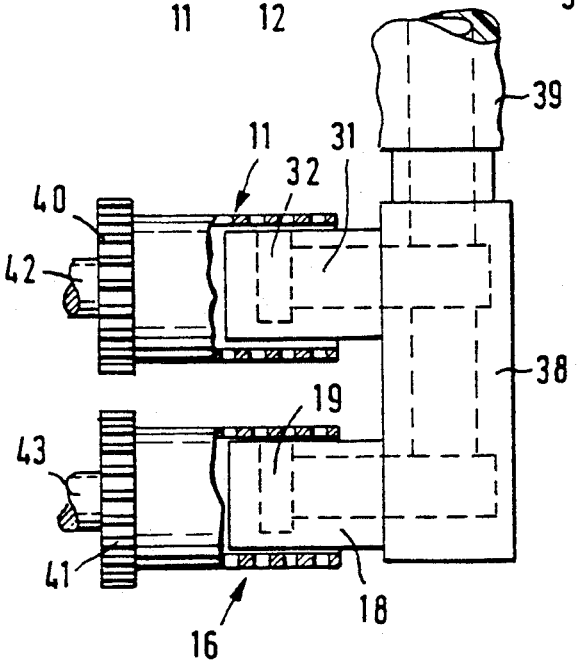
FIG. 8 is a partially sectional view of a hollow roller of the drafting unit and of the rotation body which follows which are connected to a common vacuum course.

In the embodiment according to FIG. 8, the suction insert 31 which is fitted into the hollow roller 11 and the suction insert 18 which is fitted into the rotation body 16 is mounted on a common body 38 which, by way of a flexible line 39, is connected to a vacuum source which is not shown. The hollow roller 11 and the rotation body 16 are therefore connected to the same vacuum. In this embodiment, the hollow roller 11 and the rotation body 16 are parts that have the same construction. They are nonrotatably connected with gear wheels 40, 41 mating with gear wheels of drives that are not shown. The shaft 42 of the hollow roller 11 and the shaft 43 of the rotation body 16 are disposed in a machine frame in a manner not shown in detail.

Figure 9:
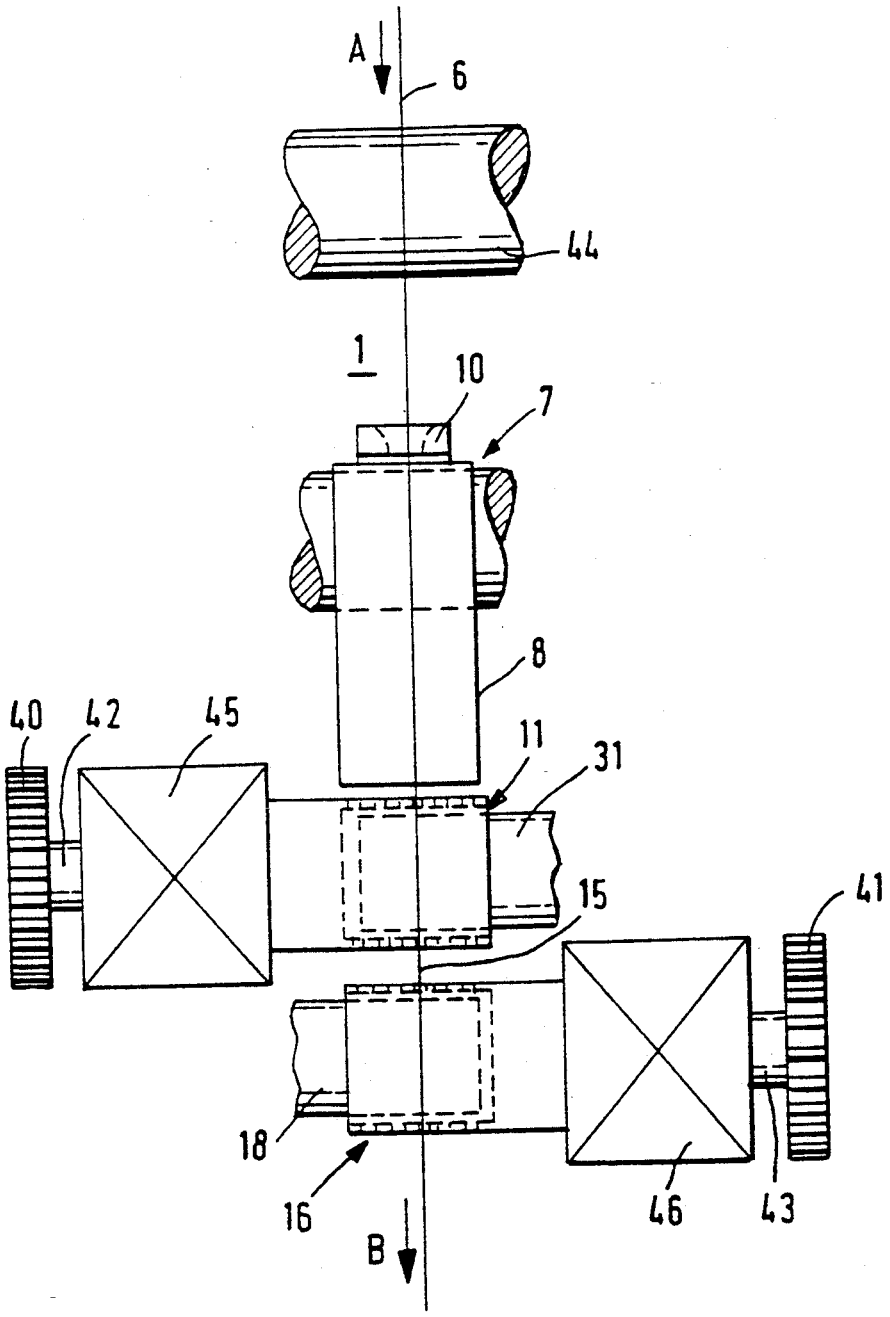
FIG. 9 is a view of an arrangement similar to FIG. 1 transversely to the travelling direction of the yarn.

FIG. 9 is a view of the arrangement according to FIG. 6 in which the pressure rollers belonging to the drafting unit and the false-twisting nozzle are not shown. As illustrated in FIG. 9, the drafting unit 1 also comprises at least one pair of rollers preceding the pair of rollers 7, the bottom roller 44 of this pair of rollers being shown. Also in the embodiment according to FIG. 9, the hollow roller 11 and the rotation body 16 are elements that have the same construction but are arranged mirror-symmetrically with respect to the travelling path of the drawn sliver 5 so that their bearing points 45, 46 are arranged on opposite sides with respect to this travelling path. It is therefore possible to move the hollow roller 11 and the rotation body 16 close to one another. The shafts 42, 43 projecting out of the bearing points 45, 46 are provided with gear wheels 40, 41 which, in a manner not shown in detail, are each connected with a drive which preferably comprises a coupling so that the hollow roller 11 and the rotation body 16 can be stopped individually at each spinning arrangement.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. Apparatus for false twist spinning, comprising:

a drafting unit including a pair of delivery rollers, a pneumatic false twisting unit downstream of the drafting unit, a withdrawal device downstream of the pneumatic false twisting unit, and a drivable rotation body subjected to suction and forming a sliver guiding surface arranged between the drafting unit delivery rollers and the pneumatic false twisting device, wherein a circumferential surface area of the rotating body is engaged by substantially the entire sliver to thereby deflect and guide the silver between the drafting means and the falsetwisting means, wherein at least one of the delivery rollers is constructed as a hollow roller having an air permeable shell surface to thereby promoting the separation of the fiber ends of the fiber at a position upstream of the sliver guiding surface of the drivable rotation body.

2. Apparatus according to claim 1, wherein a suction device which generates an air flow from the outside to the inside is arranged in the interior of the hollow roller.

3. Apparatus according to claim 2, wherein the suction device has a suction slot directed to the traveling path of the silver, particularly to the area upstream of a nip line at the delivery rollers.

4. Apparatus according to claim 1, wherein the suction device of the hollow roller and a suction device of the rotation body are connected to a common vacuum line.

5. Apparatus according to claim 3, wherein the hollow roller includes an air-permeable area of the shaft surface arranged laterally next to the traveling path of the sliver.

6. Apparatus according to claim 5, wherein the delivery roller exhibit a sliver delivery speed, wherein the rotation body is driven to a circumferential speed which is higher than the delivery speed of the pair of delivery rollers of the drafting unit and higher than a yarn withdrawal speed of the withdrawal device.

7. Apparatus according to claim 6, wherein a suction device is arranged in the rotation body which has a suction slot extending in a travelling direction of the yarn, the start of the suction slot being directed to the area of a nip line of the pair of delivery rollers of the drafting unit.

8. Apparatus according to claim 5, wherein the distance between a nip line of the pair of delivery rollers and the guiding surface of the rotation body no greater than a medium fiber length of the fiber material to be processed.

9. Apparatus according to claim 5, wherein the false-twisting device comprises a false-twisting nozzle which has a yarn duct aligned substantially tangentially with respect to the guiding surface of the rotation body.

10. Apparatus according to claim 1, wherein the hollow roller includes an air-permeable area of the shell surface arranged laterally next to a travelling path of the yarn.

11. Apparatus according to claim 1, wherein the delivery rollers exhibit a sliver delivery speed, wherein the rotation body is driven to a circumferential speed which is higher than the delivery speed of the pair of delivery rollers of the drafting unit and higher than a yarn withdrawal speed of the withdrawal device.

12. Apparatus according to claim 11, wherein the rotation body includes an air-permeable area of the shell surface arranged laterally next to a travelling direction of the yarn.

13. Apparatus according to claim 1, wherein a suction device is arranged in the rotation body which has a suction slot extending in a travelling direction of the yarn, the start of the suction slot being directed to the area of a nip line of the pair of delivery rollers of the drafting unit.

14. Apparatus according to claim 13, wherein the suction slot is arranged laterally next to the travelling direction of the yarn.

15. Apparatus according to claim 1, wherein the hollow roller and the rotation body have a diameter of maximally 30 mm, the hollow roller having a smaller diameter than the rotation body.

16. Apparatus according to claim 1, wherein the distance between a nip line of the pair of delivery rollers and the guiding surface of the rotation body is no greater than a medium fiber length of the fiber material to be processed.

17. Apparatus according to claim 1, wherein the hollow roller and the rotation body are mounted on stub shafts with respective bearings arranged on sides which are opposite with respect to the travelling path of the yarn.

18. Apparatus according to claim 1, wherein sliver engaging portions of the rotation body are offset with respect to a drafting plane extending in parallel to axes of rollers of the drafting unit.

19. Apparatus according to claim 1, wherein the false-twisting device comprises a false-twisting nozzle which has a yarn duct aligned substantially tangentially with respect to the guiding surface of the rotation body.

20. Apparatus according to claim 19, wherein the false-twisting nozzle is held by means of a holding device which can be adjusted concentrically with respect to an axis of the rotation body.

21. Apparatus according to claim 1, wherein a cleaning device is provided for at least one of the hollow roller and the rotation body.

22. Apparatus according to claim 1, wherein cleaning device means are provided for cleaning the hollow roller.

23. Apparatus according to claim 1, wherein cleaning device means are provided for cleaning the rotation body.

24. Apparatus according to claim 1, wherein a common cleaning device is provided for the hollow roller and the rotation body.

25. Apparatus according to claim 1, wherein the rotation body is a roller body which exhibits an outer circumference serving as a sliver guiding surface without any clamping of the sliver against the outer circumference by any other member to thereby facilitate control of the spread away fiber ends of the sliver as it passes over the rotation body.

26. Apparatus according to claim 1, wherein the rotation body includes means for controlling spread away fiber ends of the sliver as the sliver rotates about a sliver axis on the rotation body surface.

* * * * *